US005433449A

United States Patent [19]

Sowek

[11] Patent Number: 5,433,449

[45] Date of Patent: Jul. 18, 1995

[54] GAME TO TEST PLAYERS' KNOWLEDGE OF ROCK AND ROLL SONGS

[76] Inventor: Michael T. Sowek, 125-A-3 Hillcrest Village E., Schenectady, N.Y. 12309

[21] Appl. No.: 285,276

[22] Filed: Aug. 3, 1994

[51] Int. Cl.[6] ..... A63F 3/00

[52] U.S. Cl. ..... 273/248

[58] Field of Search ..... 273/242, 243, 248, 249, 273/252, 254

[56] References Cited

U.S. PATENT DOCUMENTS

| | | | |
|---|---|---|---|
| 4,787,639 | 11/1988 | Ross | 273/249 |
| 4,889,345 | 12/1989 | Wawryk | 273/249 |
| 4,934,709 | 6/1990 | Peterson | 273/249 |
| 5,054,775 | 10/1991 | Banks et al. | 273/431 |
| 5,092,606 | 3/1992 | Miller | 273/249 |

FOREIGN PATENT DOCUMENTS

| | | | |
|---|---|---|---|
| 2651686 | 3/1991 | France | 273/243 |
| 2672228 | 8/1992 | France | 273/254 |
| 2272838 | 6/1994 | United Kingdom | 273/252 |

*Primary Examiner*—William E. Stoll

[57] ABSTRACT

A game to test players' knowledge of rock and roll songs comprising a plurality of cards having the artist and title on top of the card and words from a rock and roll song beneath the artist and title of the song, and a lesser plurality of cards mixed in with the above cards called boobie cards which have goofy pranks to knowledge questions on them.

1 Claim, 3 Drawing Sheets

FIG. 2
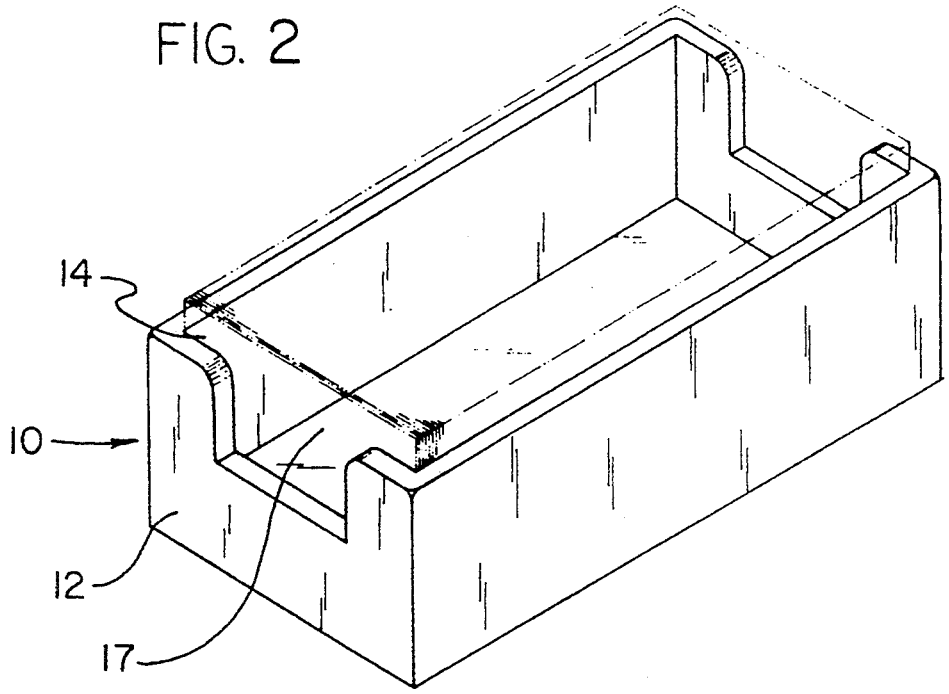
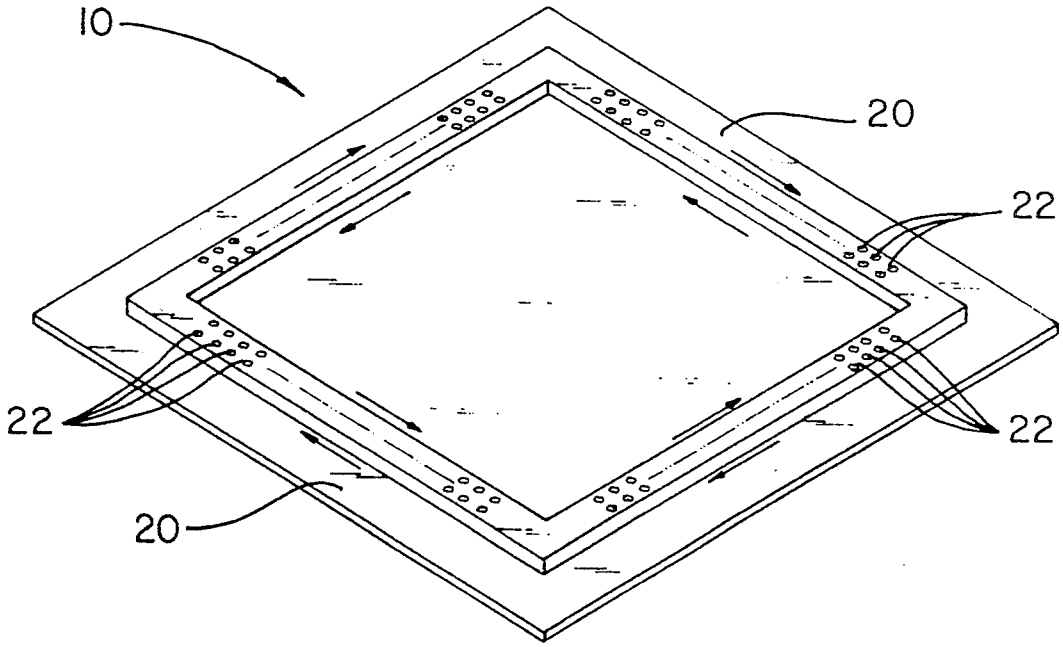
FIG. 3

GAME TO TEST PLAYERS' KNOWLEDGE OF ROCK AND ROLL SONGS

BACKGROUND OF THE INVENTION

1. Field of the Invention

The present invention relates to a new and improved game to test players' knowledge of rock and roll songs and, more particularly, pertains to playing games of skill and chance to test the knowledge of the participants in rock and roll musical knowledge.

2. Description of the Prior Art

The use of games of skill and chance wherein correctly answered questions of various topics will be rewarded is known in the prior art. More specifically, games of skill and chance wherein correctly answered questions of various topics will be rewarded heretofore devised and utilized for the purpose of playing various board games and other games of skill and chance including games requiring specific knowledge are known to consist basically of familiar, expected, and obvious structural configurations, notwithstanding the myriad of designs encompassed by the crowded prior art which has been developed for the fulfillment of countless objectives and requirements.

The prior art discloses a large number of games of skill and chance wherein correctly answered questions of various topics will be rewarded. By way of example, U.S. Pat. No. 3,994,500 to Schow discloses a musical composition board game.

U.S. Pat. No. 4,279,422 to Shaw discloses a board game involving multiple variables and performance determination.

U.S. Pat. No. 4,690,025 to Hines discloses a musical entertainment board game.

U.S. Pat. No. 4,895,374 to Bowles discloses a board game for teaching music.

Lastly, U.S. Pat. No. 5,131,663 to Klein discloses a board game with two playing areas.

In this respect, the game to test players' knowledge of rock and roll songs according to the present invention substantially departs from the conventional concepts and designs of the prior art, and in doing so provides an apparatus primarily developed for the purpose of playing games of skill and chance to test the knowledge of the participants in rock and roll musical knowledge.

Therefore, it can be appreciated that there exists a continuing need for a new and improved game to test players' knowledge of rock and roll songs which can be used for playing games of skill and chance to test the knowledge of the participants in rock and roll musical knowledge. In this regard, the present invention substantially fulfills this need.

SUMMARY OF THE INVENTION

In view of the foregoing disadvantages inherent in the known types of games of skill and chance wherein correctly answered questions of various topics will be rewarded now present in the prior art, the present invention provides a new and improved game to test players' knowledge of rock and roll songs. As such, the general purpose of the present invention, which will be described subsequently in greater detail, is to provide a new and improved game to test players' knowledge of rock and roll songs and methods which has all the advantages of the prior art and none of the disadvantages.

To attain this, the present invention essentially comprises a new and improved game to test players' knowledge of rock and roll songs comprising a holder for cards with one compartment for all playing cards, the cards having the artist and title on top of the card and words from a rock and roll song beneath the artist and title of said song, and a lesser plurality of cards mixed in with the above cards called boobie cards which have goofy pranks to knowledge questions on them; a board in a rectangular configuration having a plurality of holes around the periphery of the board, the holes adapted to indicate the path of travel of markers from hole to hole around the board; a pair of dice, each die being of a different color, whereby one color indicates the number of points to be received by answering properly a first question pertaining to a song's title and the second color indicates the number of points to be scored by answering properly a second question pertaining to a song's artist; and a plurality of markers, each marker being in the shape of musical instruments, each marker having a downwardly extending projection adapted to be removably received in an aperture of the game board.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved game to test players' knowledge of rock and roll songs which has all the advantages of the prior art games of skill and chance wherein correctly answered questions of various topics will be rewarded and none of the disadvantages.

It is another object of the present invention to provide a new and improved game to test players' knowledge of rock and roll songs which may be easily and efficiently manufactured and marketed.

It is a further object of the present invention to provide a new and improved game to test players' knowledge of rock and roll songs which is of a durable and reliable construction.

An even further object of the present invention is to provide a new and improved game to test players' knowledge of rock and roll songs which is susceptible of a low cost of manufacture with regard to both materials and labor, and which accordingly is then susceptible of low prices of sale to the consuming public, thereby making such game to test players' knowledge of rock and roll songs economically available to the buying public.

Still yet another object of the present invention is to provide a new and improved game to test players' knowledge of rock and roll songs which provides in the apparatuses and methods of the prior art some of the advantages thereof, while simultaneously overcoming some of the disadvantages normally associated therewith.

Even still another object of the present invention is to play games of skill and chance to test the knowledge of the participants in rock and roll musical knowledge.

Lastly, it is an object of the present invention to provide a game to test players' knowledge of rock and roll songs comprising a plurality of cards having the artist and title on top of the card and words from a rock and roll song beneath the artist and title of said song, and a lesser plurality of cards mixed in with the above cards called boobie cards which have goofy pranks to knowledge questions on them.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective illustration of a game card holder with regions for the rock and roll cards and the task cards.

FIG. 3 is a perspective illustration of the board for use in association with the game played with the elements of the prior Figures.

The same reference numerals refer to the same parts throughout the various Figures.

DESCRIPTION OF THE PREFERRED EMBODIMENT

Figure 1:
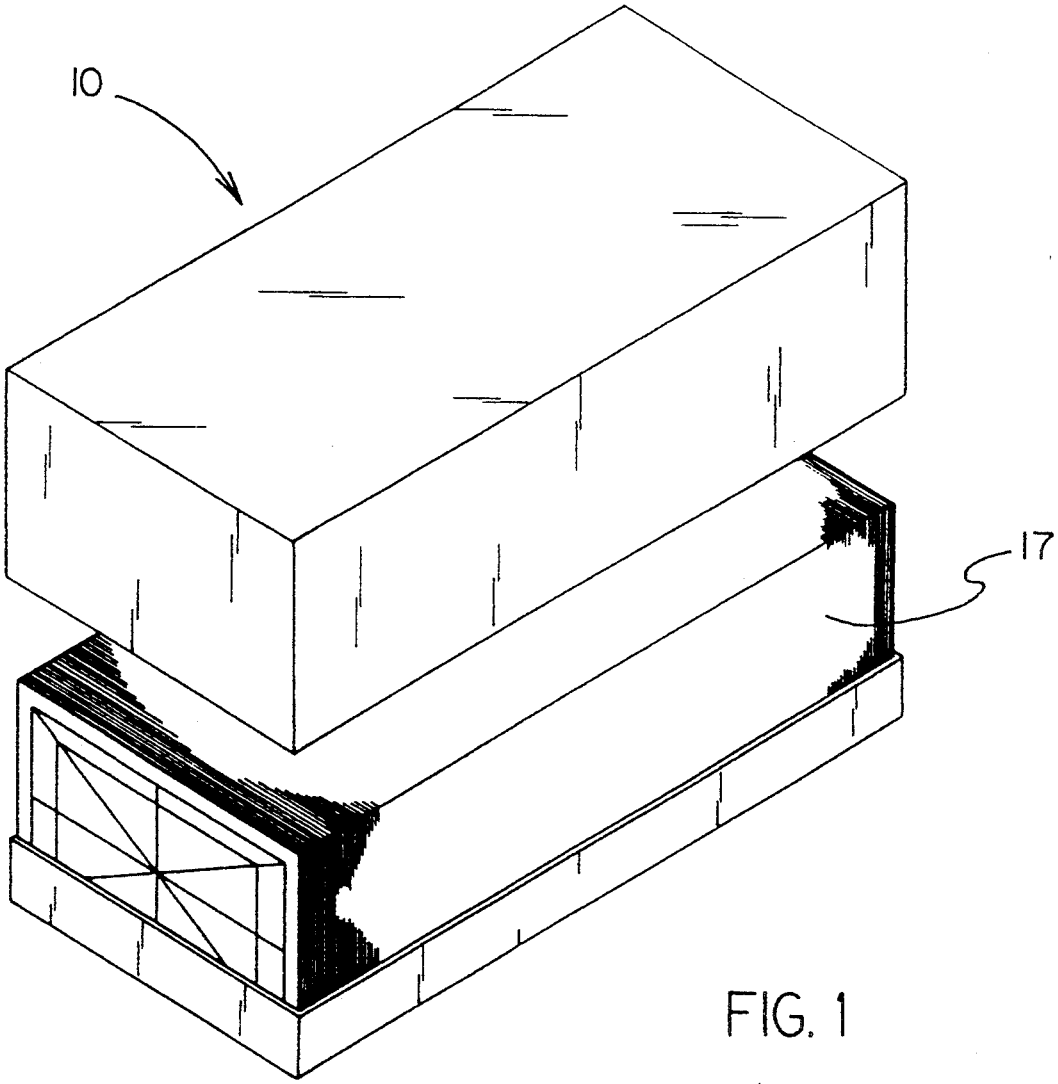
FIG. 1 is a perspective illustration of a box and a plurality of game cards of rock and roll songs constructed in accordance with the principles of the present invention.
Figure 4:
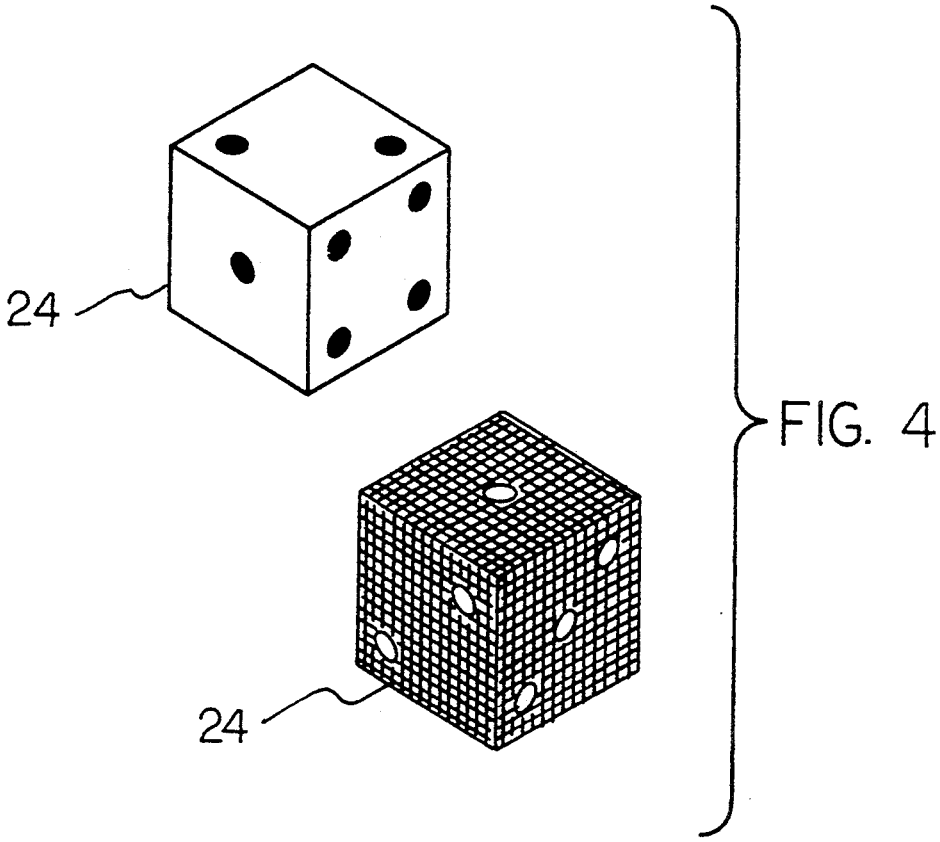
FIG. 4 is a perspective view of a pair of dice each of a different color, for use in association with the board of FIG. 2 and cards of FIGS. 1 and 2.
Figure 5:
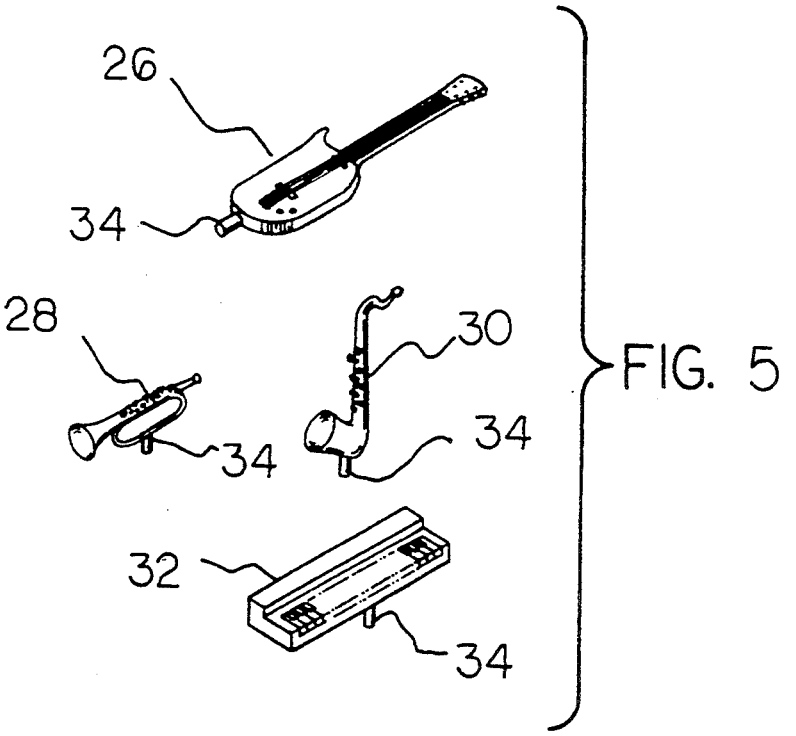
FIG. 5 is a perspective view of a plurality of game markers in the shape of musical instruments to be used by the players in moving around the game board in response to correctly answered questions.

With reference now to the drawings, and in particular to FIGS. 1 through 6 thereof, the preferred embodiment of the new and improved game to test players' knowledge of rock and roll songs embodying the principles and concepts of the present invention and generally designated by the reference numeral 10 will be described.

The present invention, the new and improved game to test players' knowledge of rock and roll songs is a system comprised of a plurality of components. The components in their broadest context include a holder, a plurality of cards with artist, title and words from a rock and roll song and a lesser plurality of cards called boobie cards, a board, dice and a plurality of markers. Each of the individual components is specifically configured and correlated one with respect to the other to attain the desired objectives.

More specifically, the game of the present invention is a system 10 which has as a central component, a holder 12. The holder is of a rigid material, as for example plastic. It is formed with one region for all playing cards. The holder may be passed from player to player for selecting the next available card.

Within the large region is a stack constituting a plurality of cards 17. All cards are positioned in the card holder region as described hereinabove including the cards having the artist and title on top of the card and words from a rock and roll song beneath the artist and title of said song, and a lesser plurality of cards mixed in with the above cards called boobie cards which have goofy pranks to knowledge questions on them.

The next major component of the system 10 is a board 20. The board is of a rigid material. It is fabricated in a rectangular configuration. It has a plurality of 52 holes 22 on each of the four sides. Each player or players have their own side of the board. The holes are in two rows. A player wins by first moving his or her playing piece along one row in a first direction and then in the second row in the opposite direction. Note the direction of the arrows. The holes are adapted to indicate the path of travel of markers from hole to hole around the board.

Next provided are a pair of dice 24. Each die is provided with the standard markings indicating the numbers between one and six. Each die is of a different characteristic such as color. In this manner, one color indicates the number of points to be received by answering questions properly. The first question pertains to a song's original or first artist to record said song. The second question pertains to the title of said song.

The last item provided are a plurality of markers 26, 28, 30, 32. Each marker is in the shape of a distinct musical instrument. Each marker has a downwardly extending projection 34. Such projection is adapted to be removably received in an aperture of the game board.

In order to maintain the cards in a clean orientation and extend their life, all cards are stored in a box with a lid when not in use.

The object of the game is for the players to correctly identify the artist and song from which they are given a line or more.

The game consists of 575 game cards of rock and roll songs all of which were in the Top 40 from the 50's through the 90's, 25 boobie cards which have the players doing different tasks from knowledge questions to goofy pranks, and a card holder. Also included is one game board, 16 inches by 16 inches, with each player or players having their own side with 52 holes in which they are to move. The game may be played in singles or teams. Other components include two dice, one black with white numbers, the other white with black numbers, and four game markers in the shape of different musical instruments.

The player, or players, rolls the two dice. One die is for spaces moved if the player/players correctly identify the original artist to record the song. The second die is for spaces moved if the player/players correctly identify the title of said song. However, if the player/-players cannot identify the original recording artist the player/players loses his moves even if he can correctly identify the title of the song. If the player/players can correctly identify the original recording artist but cannot identify the title of the song, the player/players may move as many spaces as rolled on the die that represents the spaces moved for correctly identifying the original recording artist. The first player or team of players to reach the 52nd hole is the winner of the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved game to test players' knowledge of rock and roll songs comprising, in combination:

a holder having one region for a plurality of cards; cards having the artist and title on top of the card and words from a rock and roll song beneath the artist and title of said song, and a lesser plurality of cards mixed in with the above cards called boobie cards which have goofy pranks or knowledge questions on them;

a board in a rectangular configuration having a plurality of holes around the periphery of the board, the holes adapted to indicate the path of travel of markers from hole to hole around the board;

a pair of dice, each die being of a different color, whereby one color indicates the number of points to be received by answering properly a first question pertaining to a song's artist and the second color indicates the number of points to be scored by answering properly a second question pertaining to a song's title; and a plurality of markers, each marker being in the shape of musical instruments, each marker having a downwardly extending projection adapted to be removably received in an aperture of the game board.

* * * * *